United States Patent [19]

Livnah

[11] Patent Number: 4,958,888

[45] Date of Patent: Sep. 25, 1990

[54] LOW STRESS CONCENTRATION CUTOUT COUNTERTOP

[75] Inventor: Aron Livnah, Glen Mills, Pa.

[73] Assignee: E. I. du Pont de Nemours and Company, Wilmington, Del.

[21] Appl. No.: 389,480

[22] Filed: Aug. 4, 1989

[51] Int. Cl.[5] ..... A47B 96/18

[52] U.S. Cl. ..... 312/140.3; 312/236

[58] Field of Search ..... 312/140.3, 140.1, 236; 219/391, 392

[56] References Cited

U.S. PATENT DOCUMENTS

| | | | |
|---|---|---|---|
| 1,669,802 | 5/1928 | Armstrong | 219/392 |
| 2,992,315 | 7/1961 | McDonnold | 312/236 X |
| 3,160,737 | 12/1964 | Pearce | 126/214 A |
| 3,924,602 | 12/1975 | Irwin | 126/214 A |
| 3,949,902 | 4/1976 | Thompson | 312/140.1 X |
| 4,349,713 | 9/1982 | Marsen | 312/236 |

*Primary Examiner*—Joseph Falk

*Attorney, Agent, or Firm*—Richard H. Burgess

[57] ABSTRACT

A countertop having a cutout portion, preferably for inserting a kitchen appliance with an overlapping flange, has corners with stress relief radii cut into the wider sides of the countertop to maximize the radii while keeping the cutout hidden under the flange.

7 Claims, 2 Drawing Sheets

LOW STRESS CONCENTRATION CUTOUT COUNTERTOP

BACKGROUND OF THE INVENTION

Kitchen countertops are made of a variety of materials, including laminated surfaces on chipboard, natural stone, and man-made solid surfaces simulating marble or granite. These include polymethyl methacrylate filled with alumina trihydrate.

When the countertop is provided with a cutout, generally rectangular in shape, to drop in an appliance such as a cooking stove, there are potential problems with the corners of the cutout acting as stress risers which increase stress concentration. Such appliances are provided with flanges to prevent the appliance from falling through the cutout opening. Appliances which cycle through high or low temperatures, especially cooking ranges, create thermal cycling and cyclical expansion and contraction of the countertop. Depending on conditions, this can eventually lead to cracks forming in the countertop corners which then could propagate out into the countertop and cause failure.

To minimize the stress riser effect of the corners, a 90 degree radius is normally used instead of a sharp corner. A larger radius provides less stress riser effect. However, there are limits to the size of the radius due to clearance required for the appliance.

Also, in a typical installation the front and back edges of the countertop cutout are much narrower than the edges to either side, when one looks at the counter from the position of the cook.

If the radius for the corner is partially cut back into the narrow edges, that can result in lower strength rather than stress relief.

SUMMARY OF THE INVENTION

The present invention provides a countertop having a cutout portion for inserting an appliance which has a flange overlapping the edges of the cutout to support the appliance and hide the cutout, with clearance between the appliance and the edges, said countertop having four sides which if extended, would meet in four corners which would act as stress risers, one pair of said sides defining opposite edges of said cutout being narrower than the other wider pair of said sides, each of said corners having a smooth curved portion removed from the wider side to reduce the stress riser effect of the corners, said curved portion being of a size and position that maximizes its effective radius while remaining within the portion of the edge to be covered by the appliance flange.

DETAILED DESCRIPTION

It is common knowledge that a large inside corner radius will reduce stress concentration at a corner. However, a cutout corner radius larger than the usual 0.5 cm may interfere with the installation of the desired appliance such as a cooktop, stove hot water heating pans, ice sink, etc. A concept behind the invention is to reduce stress concentration at the corners of appliance cutouts by introducing a unique larger radius which does not expose the cutout edges beyond the appliance's flange width while at the same time not interfering with installation. To achieve improved crack resistance without installation interference a technique was developed of cutting a larger corner radius into the cutout edge with the widest side, preferably starting at a tangent point further into the cutout then where the appliance edges will be.

Larger corner radii are known to reduce stress. Only a 90 degree circular section is available with limited radius, however. Making a larger corner radius involves removal of less material at the corner which then interferes with the proper installation of appliances. The invention allows for introduction of a larger radius without concomitant interference with appliance installation.

Attempting to make a larger radius to lessen interference during appliance installation (making a larger cutout) risks the possibility of the appliance shifting slightly causing cutout exposure. This also reduces peripheral support of the appliance and increases the probability of the appliance dropping into the cutout.

Figure 1:
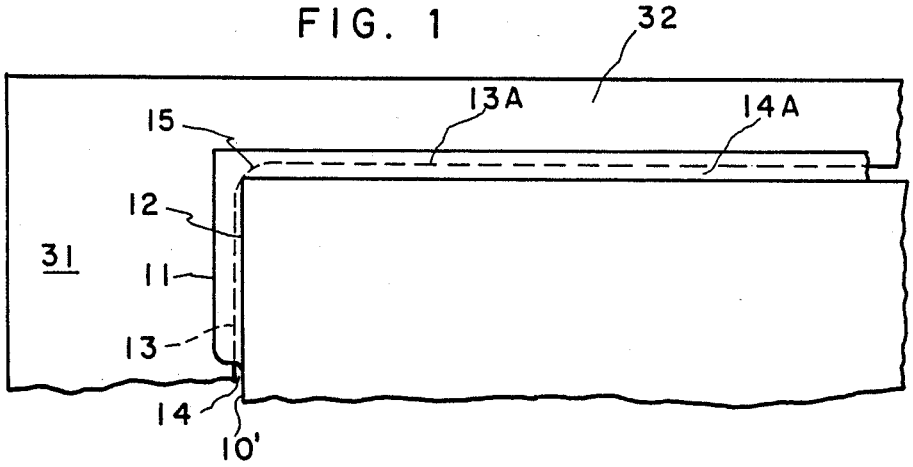
FIG. 1 is a schematic representation showing a corner of a standard countertop cutout, illustrating flange overlap for support and potential corner interference with a large radius.

Turning now to the drawings, FIG. 1 illustrates the prior art. Note that the curve at the corner is tangent to both sides of the cutout. An appliance or appliance housing 10, such as for a cooking stove, sits down inside an opening in countertop 30 defined by edges 13 and 13A cut into wider side 31 and narrower side 32. This leaves clearance 14 and 14A.

Flange 11 of appliance 10 overlays sides 31 and 32 to support appliance 10 and cover edges 13 and 13A.

Corner 12 of appliance 10 is in the region of radius 15 of countertop 30. It will be seen from Figure that a larger radius 15 will either soon interfere with corner 12 or cause flange 11 not to cover edges 13 or 13A.

However, it is desirable to have effectively a larger radius 15 to decrease the stress concentration there. Although this description is in terms of one corner of the cutout in countertop 10 it applies to all four corners as best seen in FIG. 4.

Figure 2:
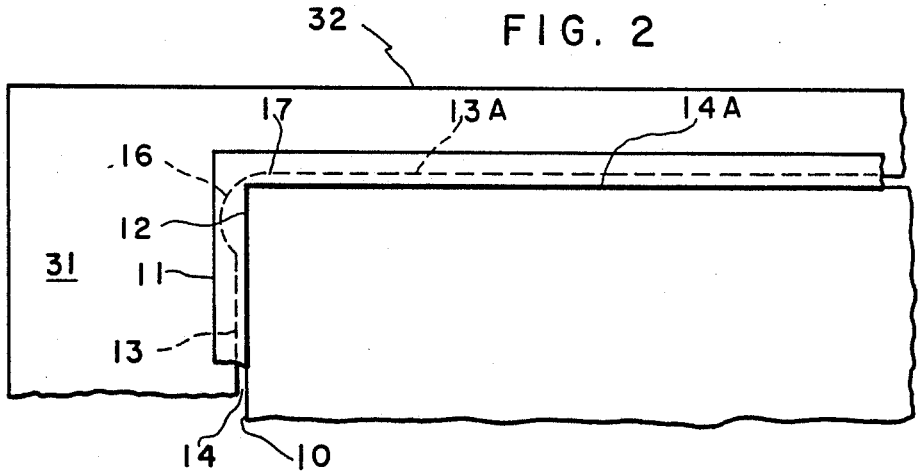
FIG. 2 is a schematic representation of a countertop cutout of the invention.
Figure 3:
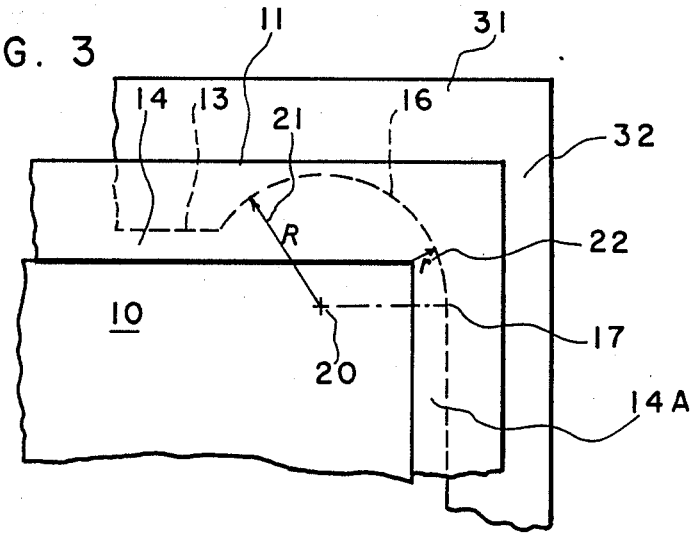
FIG. 3 is a detail of FIG. 2.

To better understand the nature and the advantages of the invention, see FIGS. 2 and 3. Instead of cutting radius 15 evenly at the corner, radius 16 is cut entirely into the wider side 31 and not at all into narrower side 32. Preferably the cut is tangent to edge 13A at point 17 which is further from edge 13 than is appliance 10 to maximize radius (R) 21 and to keep distance (r) 22 between the corner of appliance 10 and radius 16 larger enough to permit installation without interference and to allow for thermal expansion of appliance 10. As will be seen, the cut is not tangent to wider side 31. Generally an r 22 of about 0.3cm is sufficient. The location of center point 20 for radius 16 can be determined by trial and error, by experience, by tool fitting, or by calculation, as will be apparent to those skilled in the art.

Figure 4:
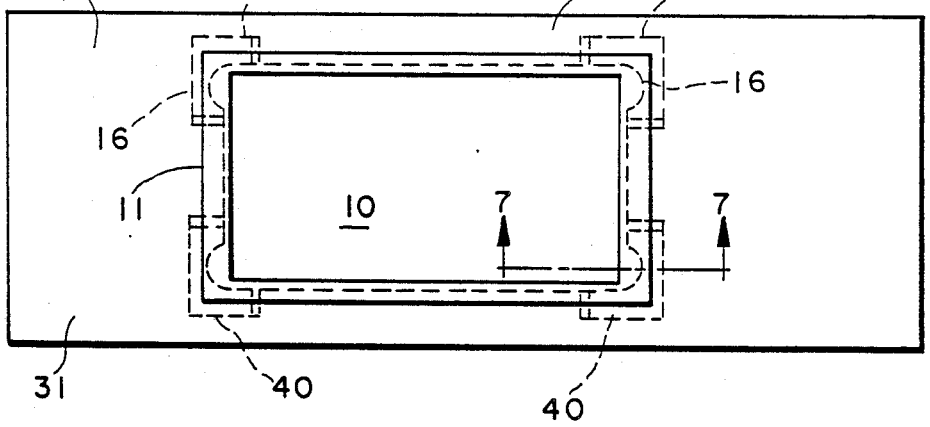
FIG. 4 is a plan view of a countertop of the invention showing corner reinforcements in dotted lines and the placement of the appliance in phantom lines.

FIG. 4 illustrates cooktop 10 set in place in complete countertop 31, showing all four corners.

Figure 5:
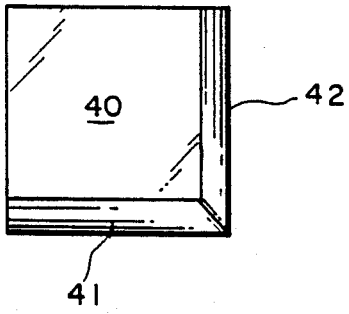
FIGS. 5 and 6 show the reinforcements in plan and side views, respectively.
Figure 6:
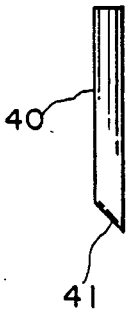

FIGS. 5 and 6 show reinforcement blocks 40 that can be adhered by known techniques beneath each corner of the cutout before cutting radius 16, and each cut can then be made in both countertop 31 and block 40 simultaneously. Preferably, block 40 has chamfered edges 41 and 42 to further diminish stress concentration.

Figure 7:
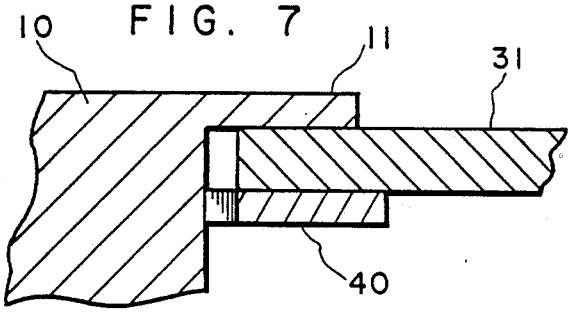
FIG. 7 is a partial section along line 7—7 in FIG. 4 showing aspects of the invention in elevation.

FIG. 7 provides perspective on the arrangement of appliance 10 and flange 11 in countertop 31.

Introducing reinforcement blocks, preferably made of the same material as the countertop and glued to the underside of the countertop at the cutout corners, will increase the cutout corner resistance to cracking by virtue of increasing the cross section at the corner and thus reducing the stress. The common procedure of reinforcing the cutout by adding a full peripheral collar made of the same material as the countertop and glued to the underside of the countertop around the cutout edge is not very effective in increasing cutout resistance to thermally induced cracks. The reason is that the reinforcement collar itself is exposed to the appliance'-heat and therefore also induces stress at the cutout corner, and thus substantially reduces the effect of the reinforcement.

Both lab test results and field installations demonstrated significant improvements in countertop cutout resistance to thermally induced cracking with the fabrication techniques of the invention.

By way of example, using the invention with a radius R 16 of 7.5cm in FIG. 3, for an appliance clearance 14 of 0.6cm, corner clearance r 22 of 0.3cm, a narrow edge 32 of 7.6cm width, and flange width 11 of 5.1cm, the stress concentration factor is 1.0. For the same installation done according to the prior art, FIG. 1, the stress concentration factor with a radius 15 of 1.4cm is about 1.65. Thus, the invention provides an improvement of 61% in the stress concentration.

I claim:

1. A countertop having a cutout portion for inserting an appliance which has a flange overlapping the edges of the cutout to support the appliance and hide the cutout, with clearance between the appliance and the edges, said countertop being substantially horizontally oriented, said countertop having four sides, one pair of said sides defining opposite edges of said cutout being narrower than the other wider pair of said sides, each of said corners having a smooth curved cutout portion extending into the wider side to reduce the stress riser effect of the corners, said curved portion being of a size, shape and position that maximizes its effective stress-relief effect while remaining within the portion of the edge to be covered by the appliance flange.

2. The countertop of claim 1 wherein the curved portions are segments of a circle tangent only to the narrower sides.

3. The countertop of claim 2 wherein the cutout is rectangular.

4. The countertop of claim 3 wherein the radius of the circle is tangent to the narrower edge at a point on the edge further into the cutout than the corner, but with the curved portion being sized to provide clearance from the corner of the appliance to be inserted into the cutout.

5. The countertop of claim 1 with reinforcement lugs adhered to the bottom of each corner, and the same curved portion being removed from the lugs corresponding to that of the adjacent countertop.

6. The countertop of claim 1 adopted to receive a kitchen appliance which heats during use.

7. The countertop of claim 6 wherein the appliance is a cooking stove.

* * * * *